United States Patent [19]

Cook

[11] Patent Number: 5,018,725

[45] Date of Patent: May 28, 1991

[54] ADJUSTABLE EXERCISE EQUIPMENT

[76] Inventor: Roger D. Cook, 10528 Decatur St., Omaha, Nebr. 68114

[21] Appl. No.: 558,081

[22] Filed: Jul. 25, 1990

[51] Int. Cl.[5] ..... A63B 21/062

[52] U.S. Cl. ..... 272/118; 272/116; 272/134; 272/144

[58] Field of Search ..... 272/134, 135, 136, 116, 272/117, 118, 143, 144, 145, DIG. 4

[56] References Cited

U.S. PATENT DOCUMENTS

| | | | |
|---|---|---|---|
| 1,547,268 | 7/1925 | Sotomayor | 272/118 |
| 4,549,733 | 10/1985 | Salyer | 272/118 |
| 4,603,855 | 8/1986 | Sebelle | 272/117 |
| 4,634,118 | 1/1987 | Jensen | 272/134 X |
| 4,640,268 | 2/1987 | Roberts | 272/143 X |
| 4,842,270 | 6/1989 | Lange | 272/117 |
| 4,848,740 | 7/1989 | VanDerHoeven | 272/134 |

*Primary Examiner*—Richard J. Apley
*Assistant Examiner*—L. Thomas
*Attorney, Agent, or Firm*—Zarley, McKee, Thomte, Voorhees & Sease

[57] ABSTRACT

An adjustable exercise apparatus of the present invention includes a vertically-oriented frame having an operable cable threaded therethrough connecting a pull bar to a plurality of weights. The cable is directed over pulleys so that a person pulling on the pull bar will lift the weights against the force of gravity. A pair of curved guide rails extend upwardly and forwardly from the forward end of the frame with the center of the arch of the guide rails located generally above the seat upon which the person will sit to operate the apparatus. A carriage is mounted on the guide rails and is designed to guide the cable from the weights to the pull bar. The carriage may be selectively positioned at a plurality of points along the guide rails from the forward upper end to the rearward lower end. A spring-actuated pin cooperable with a plurality of apertures in one of the guide rails to maintain the carriage in a predetermined position. Release of the pin from the aperture permits movement of the carriage along the guide rails.

8 Claims, 3 Drawing Sheets

ADJUSTABLE EXERCISE EQUIPMENT

TECHNICAL FIELD

The present invention relates generally to exercise equipment, and more particularly to a piece of exercise equipment which has been modified to permit adjustability, and thereby permit a wide variety of different exercising angles.

BACKGROUND OF THE INVENTION

With the increasing popularity of body development and exercises for the purpose of increasing tone, size and definition of musculature, various types of machines have been utilized wherein a person pulls cables against resistance. Typically, the resistance on the cable is provided by weights.

Various exercises may best be accomplished by having the cable extend from the exercise machine at a variety of heights, depending upon the nature of the specific exercise and the build of the person using the apparatus. One exercise apparatus which provides height adjustability is that disclosed in U.S. Pat. No. 4,603,855 to Sebelle. U.S. Pat. No. 4,848,740 to VanDerHoeven discloses an exercise apparatus which permits the person to pull a cable generally horizontally, or modify the apparatus to pull the cable from a vertical position. Thus, prior art exercise machines have provided some adjustability to the users, by permitting vertical adjustment of the pulley upon which the cable is wrapped before extending to the weights.

Bodybuilders and others who utilize weight lifting equipment as well as similar exercise equipment, are invariably seeking to create new and different exercises. Commonly, variations on conventional exercises provide enough modification so as to develop different portions of the various muscle groups.

However, none of the prior art devices permit the user to quickly adjust the apparatus from a directly horizontal-pull, to a vertical-pull apparatus. Nor do prior art machines permit adjustability between the horizontal- and vertical-pull orientations.

It is therefore a general object of the present invention to provide an improved adjustable exercise apparatus.

Another object of the present invention is to provide an exercise apparatus which is adjustable between a horizontal pull and vertical pull orientation.

A further object of the present invention is to provide an exercise apparatus which is adjustable to a plurality of positions between directly horizontal and directly vertical.

Yet another object is to provide an exercise apparatus which may be simply and easily adjusted to a different position.

Still another object is to provide an adjustable exercise apparatus which is simple to operate and refined in appearance.

These and other objects will be apparent to those skilled in the art.

SUMMARY OF THE INVENTION

The adjustable exercise apparatus of the present invention includes a vertically-oriented frame having an operable cable threaded therethrough connecting a pull bar to a plurality of weights. The cable is directed over pulleys so that a person pulling on the pull bar will lift the weights against the force of gravity. A pair of curved guide rails extend upwardly and forwardly from the forward end of the frame with the center of the arch of the guide rails located generally above the seat upon which the person will sit to operate the apparatus. A carriage is mounted on the guide rails and is designed to guide the cable from the weights to the pull bar. The carriage may be selectively positioned at a plurality of points along the guide rails from the forward upper end to the rearward lower end such that the pull bar may be pulled from a wide variety of different positions. A spring-actuated pin is cooperable with a plurality of apertures in one of the guide rails to maintain the carriage in a predetermined position. Release of the pin from the aperture permits movement of the carriage along the guide rails.

BRIEF DESCRIPTION OF THE DRAWINGS

FIG. 1; and

DESCRIPTION OF THE PREFERRED EMBODIMENT

Figure 1:
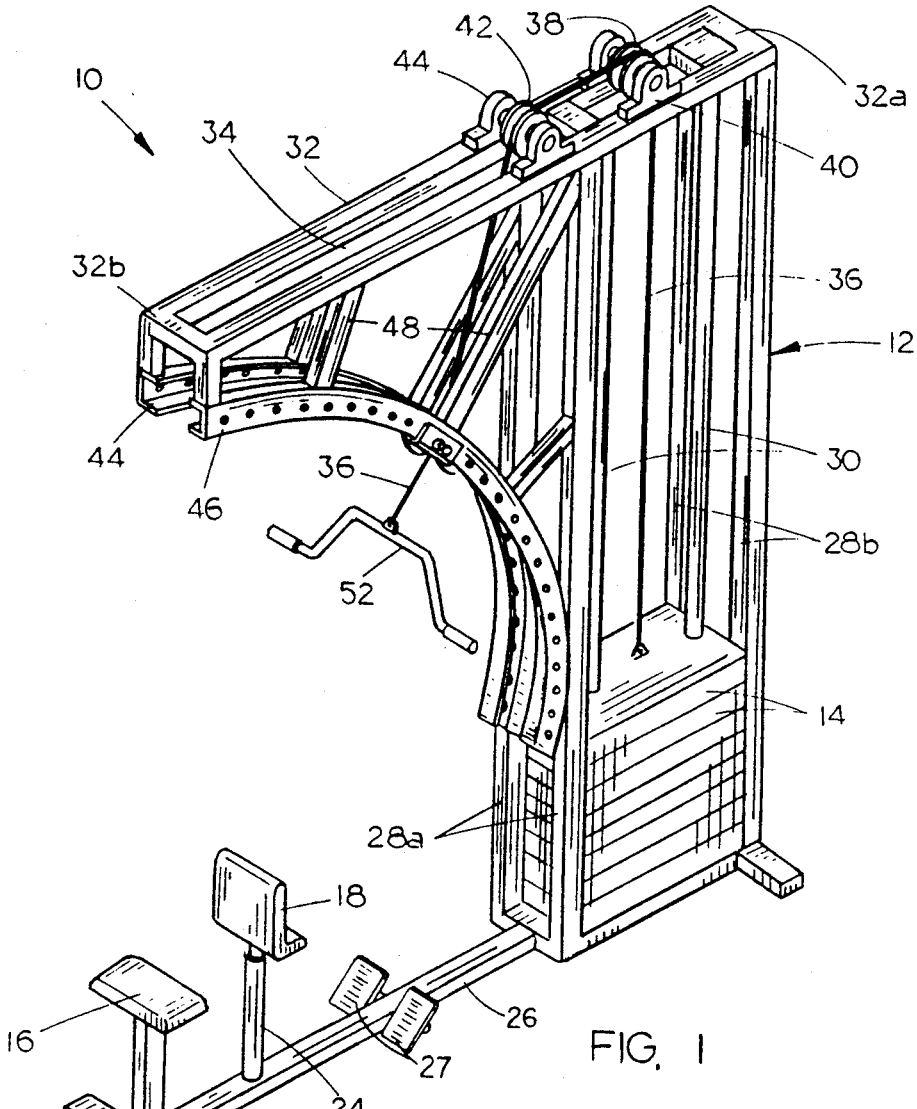
FIG. 1 is a perspective view of the present invention.

Referring now to the drawings in which similar or corresponding parts are identified with the same reference numeral, and more particularly to FIG. 1, the exercise apparatus of the present invention is designated generally at 10 and includes a frame 12 upon which a plurality of weights 14 are operably mounted, a seat 16 for a person to sit on, and a body support 18 to prevent movement of the body during exercising.

Seat 16 is adjustably mounted on a shaft 20, and is capable of vertical adjustment for the particular user. A horizontally projecting leg 22 projects from the bottom of shaft 20 to stabilize the seat in position.

Body support 18 is adjustably mounted on a second shaft 24 between seat 16 and frame 12, as shown in the drawings. Body support 18 is vertically adjustable in a fashion similar to seat 16. An elongated spacer bar 26 extends from frame 12 and maintains shafts 20 and 24 in spaced relation from frame 12. A pair of foot braces 27 are adjustably mounted on spacer bar 26, which assist in bracing a person during a horizontal pull, thereby relieving a portion of the pressure on the chest caused by support 18.

Frame 12 includes four vertically-oriented, elongated members 28 which are spaced apart such that weights 14 are vertically movable therebetween. Elongated members 28*a* are parallel and spaced forwardly of rearward elongated members 28*b*, towards seat 16. A pair of vertical rails 30 are journaled through apertures in weights 14 and serve to guide weights 14 vertically between elongated members 28.

A top member 32 is connected to the upper ends of elongated members 28 and guide rails 30 and holds them in spaced-apart relation. Top member 32 cantilevers outwardly from frame 12 over spacer bar 26, and extends to a position directly over seat 16. Top member 32 has an elongated slot 34 formed therein extending from rearward end 32*a* to forward end 32*b*, such that a cable 36 will pass therethrough.

A first pulley 38 is operably mounted on a pair of pillow blocks 40 directly above weights 14 on top member 32. Pulley 38 is freely rotatable and located over slot 34 such that cable 36 will extend from weights 14 through slot 34 and over pulley 38. A second pulley 42 is mounted on a pair of pillow block bearings 44 forwardly and spaced from first pulley 38, such that cable 36 will extend from pulley 38 over the top of elongated members 28 and thence over pulley 42.

Figure 2:
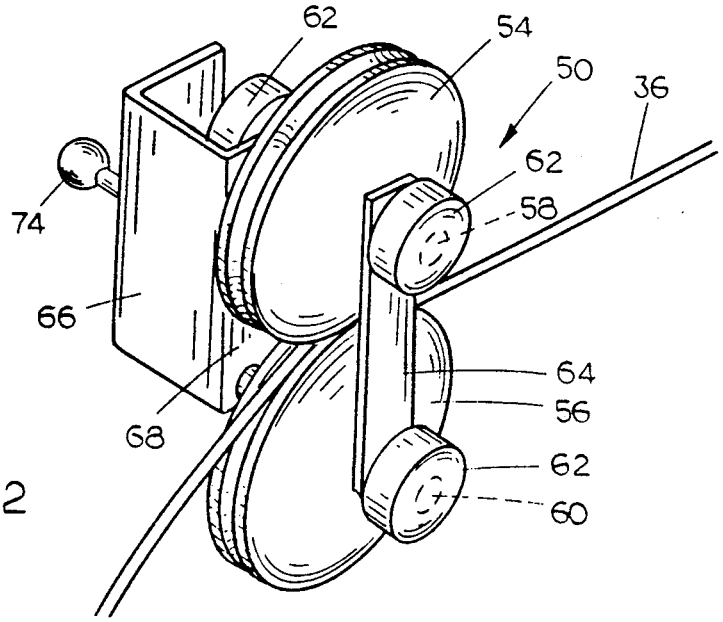
FIG. 2 is an enlarged perspective view of the adjustable carriage of the invention.

A pair of channels 44 and 46 are bent to an arcuate shape having identical radiuses form an approximate 90 degree arch. Channels 44 and 46 extend from the forward end **32*b* of top member 32 rearwardly and downwardly to an intermediate point on the forward pair 28*a* of elongated members 28. A plurality of cross members 48 extend from channels 44 and 46 to top member 32 and elongated members 28*a* so as to maintain channels 44 and 46 in spaced-apart, parallel relation with the open portion of the channels facing one another to form guide rails. A carriage 50, as shown in FIG. 2, is operably mounted between channels 44 and 46 and is selectively operable along the channels. As shown in FIG. 1, cable 36 extends through carriage 50 to a pull bar 52 so as to allow the user to exercise by pulling on the cable and lifting weights 14**.

Carriage 50 includes a pair of pulleys 54 and 56, each mounted on an axle 58 and 60 respectively. Each axle 58 and 60 has a wheel 62 on each end thereof of a size designed to fit within channels 44 and 46. A rigid strap 64 extends between axles 58 and 60 so as to hold pulleys 54 and 56 spaced apart in edge-to-edge relationship. A U-shaped channel 66 has one side wall 68 with apertures therethrough to receive axles 58 and 60 on the opposite side of pulleys 54 and 56 with respect to strap 64. Thus, wall 68 and strap 64 maintain pulleys 54 and 56 in rotatable, spaced relation. An annular groove 70 and 72 is formed in the peripheral edge of each pulley 54 and 56, respectively, which will receive cable 36 thereon.

Figure 5:
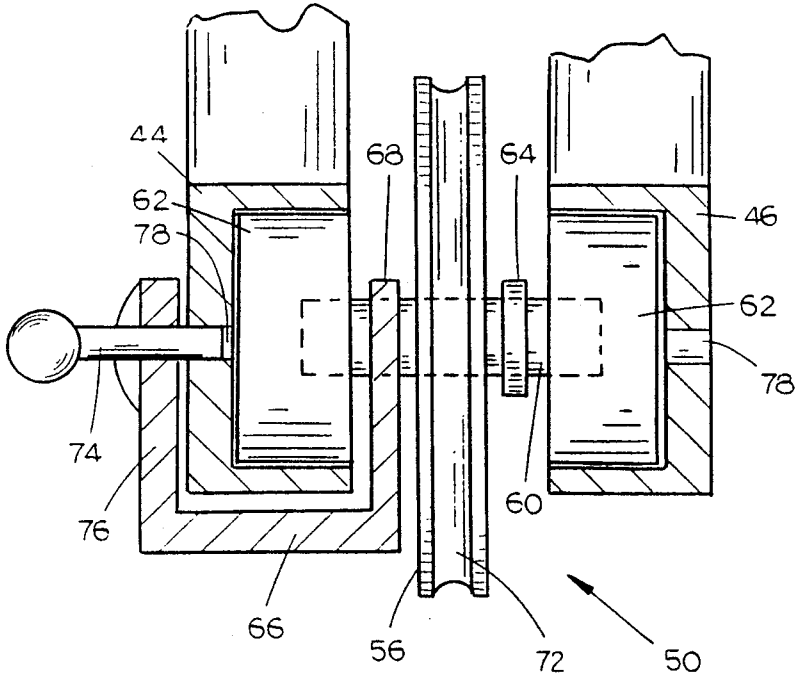
FIG. 5 is a sectional view taken at lines 5—5 in FIG. 4.

Channel 66 on carriage 50 has an operable pin 74 connected thereto which extends through side wall 76 so as to be selectively journaled within one of a plurality of apertures 78 in channel 44, as shown in FIG. 5. Preferably, pin 74 is spring biased so as to maintain the pin within aperture 78 in channel 44.

Figure 4:
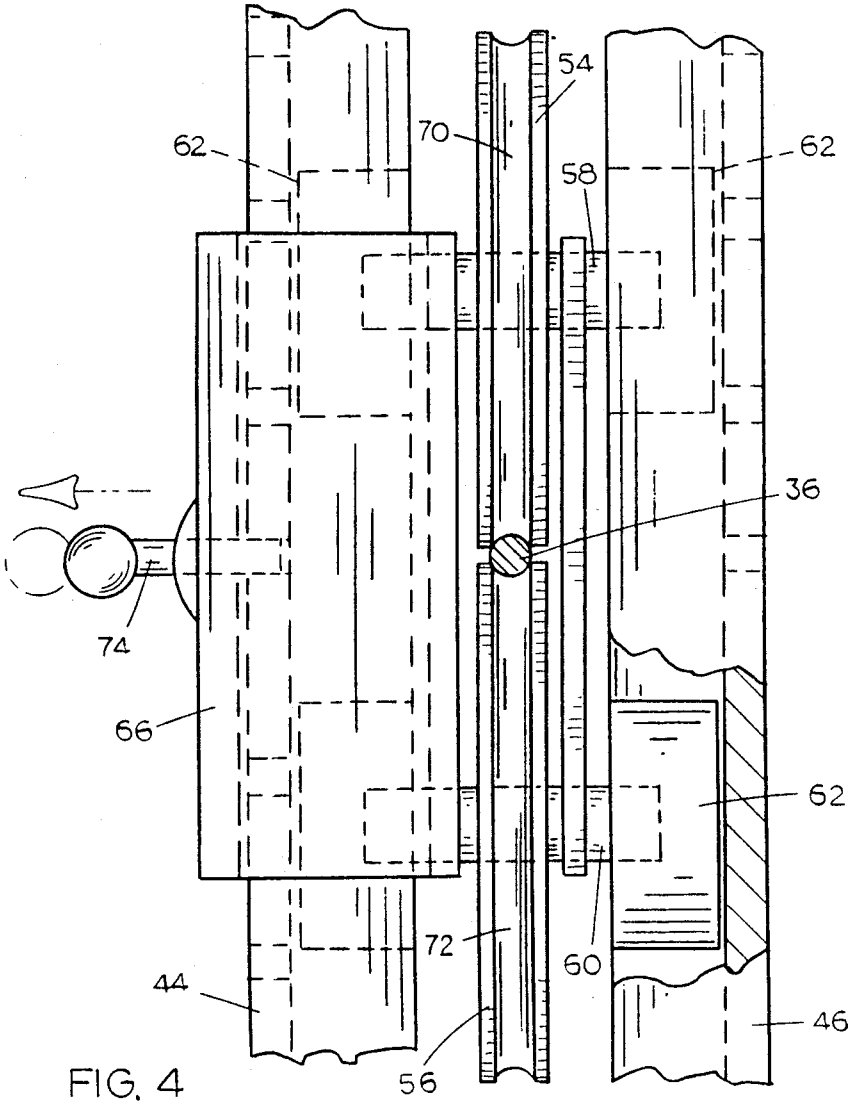
FIG. 4 is a partial sectional view taken at lines 4—4 in FIG. 1.

In operation, carriage 50 is mounted with wheels 62 within channel 44 and 46, as shown in FIGS. 4 and 5. Cable 36 extends between pulleys 54 and 56 from pull bar 52, and extends over pulleys 42 and 38 and thence downwardly to weights 14. To use the apparatus, pin 74 is pulled outwardly such that carriage 50 may roll along channels 44 and 46, pin 74 being journaled in the selected aperture 78 in channel 44. It should be noted that carriage 50 may be reversed such that pin 74 is journaled in an aperture 78 in channel 46, such that the carriage may be used with either a right-handed or left-handed person.

Figure 3:
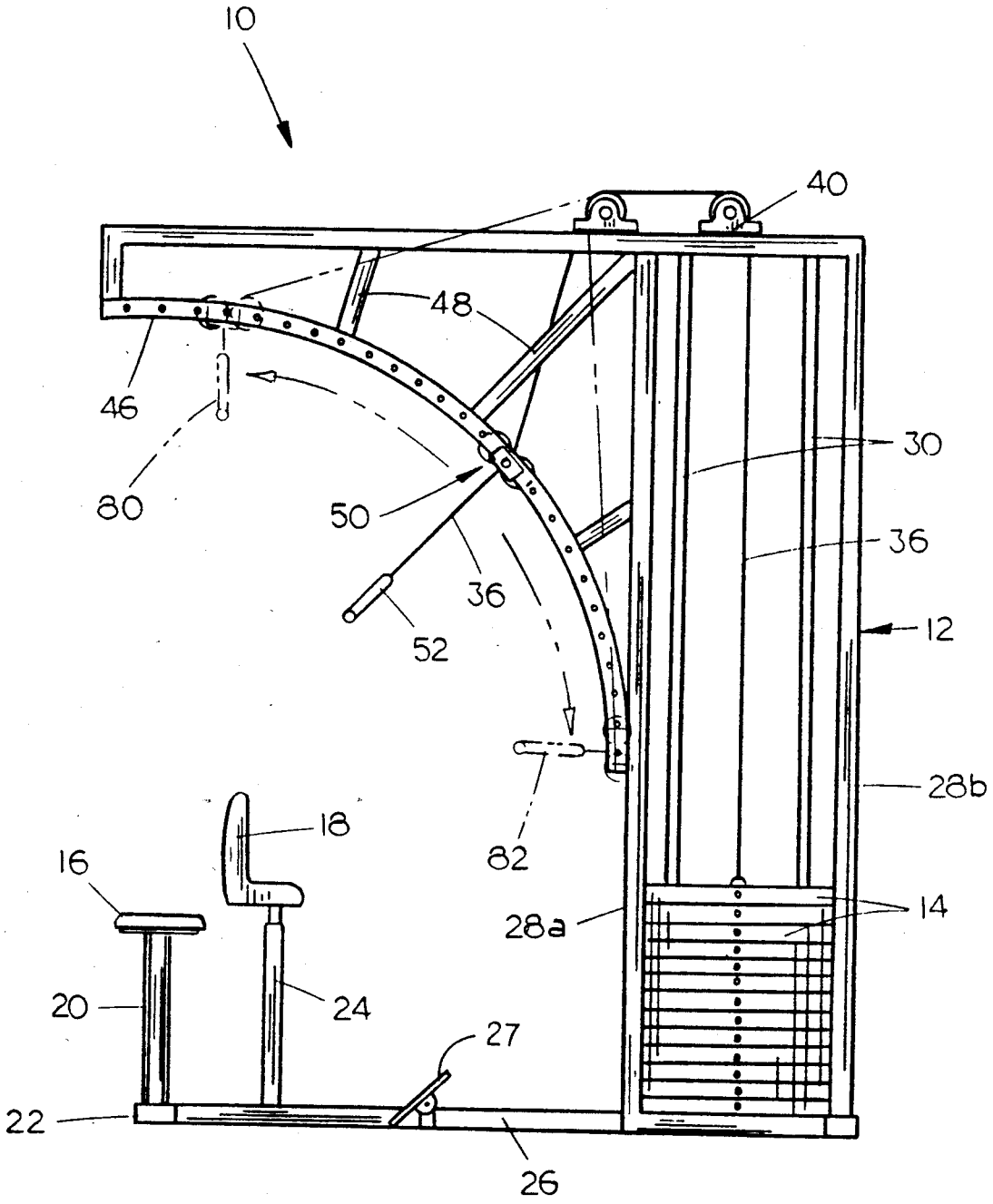
FIG. 3 is a side elevational view of the invention.

Because of the arched shape of channels 44 and 46, carriage 50 may be moved to a position directly above seat 16, as shown in broken lines at 80 in FIG. 3. Carriage 50 may also be moved to a position directly horizontal and outward from the midsection of the user, at a position indicated at 82 in FIG. 3. Further, the arched shape and the plurality of apertures along channels 44 and 46 permits carriage 50 to be located at a multitude of positions in between the horizontal and vertical, as shown in FIG. 3.

Whereas the invention has been shown and described in connection with the preferred embodiments thereof, it will be understood that many modifications, substitutions and additions may be made which are within the intended broad scope of the appended claims. There has, therefore, been shown and described an improved adjustable exercise apparatus which accomplishes at least all of the above-stated objects.

I claim:

1. An adjustable exercise apparatus, comprising:

a frame having a forward end and a rearward end;

a cable operably threaded through said frame to connect a pull bar to a resistance-producing means;

a pull bar connected to said cable, adapted for selective gripping by a person;

a resistance-producing means connected to said cable for resisting the movement of said cable caused by pulling on the pull bar;

guide rail means having a forward and rearward end, mounted on said frame and extending upwardly and forwardly from the forward end of said frame;

said guide rail means including first and second horizontally, spaced-apart guide rails; and a carriage operably connected to said guide rail means for selective movement therealong, said carriage having means for operably guiding cable therethrough from said resistance-producing means to said pull bar; and said carriage being operably mounted between said guide rails with said cable passing between said guide rails.

2. An adjustable exercise apparatus, comprising:

a frame having a forward end and a rearward end;

a cable operably threaded through said frame to connect a pull bar to a resistance-producing means;

a pull bar connected to said cable, adapted for selective gripping by a person, a resistance-producing means connected to said cable for resisting the movement of said cable caused by pulling on the pull bar;

guide rail means having a forward and rearward end, mounted on said frame and extending upwardly and forwardly from the forward end of said frame;

said guide rail means being curved from the forward to rearward ends, with a radial center located generally forward of said frame and generally below said forward end of said guide rail means; and a carriage operably connected to said guide rail means for selective movement therealong, said carriage having means for operably guiding cable therethrough from said resistance-producing means to said pull bar.

3. The adjustable exercise apparatus of claim 1, further comprising selective locking means on said carriage, for selectively locking said carriage on said guide rail means to prevent movement therealong during operation of said pull bar and cable.

4. The adjustable exercise apparatus of claim 3, wherein said selective locking means includes a pin operatively connected to said carriage and selectively cooperable with an aperture in said guide rail means, and said guide rail means having a plurality of apertures formed therein for cooperation with said operable pin, located from the forward to the rearward end of said guide rail means.

5. The adjustable exercise apparatus of claim 2, wherein said resistance-producing means includes a plurality of weights connected to said cable for operable vertical movement on said frame.

6. An adjustable exercise apparatus, comprising:

a frame having a forward end and a rearward end;

a cable operably threaded through said frame to connect a pull bar to a resistance-producing means;

a pull bar connected to said cable, adapted for selective gripping by a person;

a resistance-producing means connected to said cable for resisting the movement of said cable caused by pulling on the pull bar;

guide rail means having a forward and rearward end, mounted on said frame and extending upwardly and forwardly from the forward end of said frame;

a carriage operable connected to said guide rail means for selective movement therealong, said carriage having means for operably guiding cable therethrough from said resistance-producing means to said pull bar;

a seat mounted forwardly of said frame means and directly below the forward end of said guide rail means, upon which a person may be seated to pull on said pull bar; and said guide rail means being curved from the forward to rearward ends, with a radial center located directly above said seat.

7. The adjustable exercise apparatus of claim 6, wherein said guide rail means extends through at least a quarter of a circle.

8. An adjustable exercise apparatus, comprising:

a frame having a forward end and a rearward end;

a cable operably threaded through said frame to connect a pull bar to a resistance-producing means;

a pull bar connected to said cable, adapted for selective gripping by a person;

a resistance-producing means connected to said cable for resisting the movement of said cable caused by pulling on the pull bar; guide rail means having a forward and rearward end, mounted on said frame and extending upwardly and forwardly from the forward end of said frame;

said guide rail means being curved from the forward to rearward end; and a carriage operably connected to said guide rail means for selective movement therealong, said carriage having means for operably guiding cable therethrough from said resistance-producing means to said pull bar.

* * * * *